US005529206A

United States Patent [19]

Kumagai

[11] Patent Number: 5,529,206

[45] Date of Patent: Jun. 25, 1996

[54] GAME MACHINE HAVING AUTOMATIC GIFT EJECTING FUNCTION

[75] Inventor: Toshinori Kumagai, Tokyo, Japan

[73] Assignee: Able Corporation Ltd., Tokyo, Japan

[21] Appl. No.: 297,561

[22] Filed: Aug. 26, 1994

[30] Foreign Application Priority Data

Apr. 8, 1994 [JP] Japan ..... 6-095693
Jul. 13, 1994 [JP] Japan ..... 6-009573 U

[51] Int. Cl.[6] ..... G07F 11/00

[52] U.S. Cl. ..... 221/5; 221/8; 221/90; 340/825.35; 340/323 R

[58] Field of Search ..... 221/2, 4, 5, 6, 221/8, 69, 88, 89, 90, 126, 129, 130, 131, 155; 340/825.35, 323

[56] References Cited

U.S. PATENT DOCUMENTS

| | | | |
|---|---|---|---|
| 2,585,371 | 2/1952 | Coffing | 221/90 |
| 3,163,325 | 12/1964 | Mihalek | 221/90 |
| 4,284,206 | 8/1981 | Wittern | 221/90 |
| 4,560,088 | 12/1985 | Tan | 221/129 |
| 4,676,395 | 6/1987 | Croe | 221/2 |
| 5,133,478 | 7/1992 | Gordon | 221/90 |

FOREIGN PATENT DOCUMENTS

| | | | |
|---|---|---|---|
| 406124381 | 5/1994 | Japan | 221/5 |
| 1156993 | 7/1969 | United Kingdom | 221/90 |
| 2240543 | 8/1991 | United Kingdom | 221/2 |

*Primary Examiner*—H. Grant Skaggs
*Attorney, Agent, or Firm*—Spencer & Frank

[57] ABSTRACT

A game machine is provided with an automatic gift ejecting function of selecting gifts, even if in different forms, through game-like operations and automatically ejecting the gifts without using special capsules or the like by using devised gift display, gift selection and selection indication methods. The game machine has a gift display portion including a plurality of vertically arranged tiers each having a plurality of gifts placed horizontally, a selection indicating device for indicating gift display positions respectively corresponding to the gifts, a tier selection device for selecting one of the plural tiers, a horizontal position selection device for selecting one of the gift display positions of the horizontally arranged gifts, and an automatic gift ejecting device for automatically ejecting one of the gifts selected by the tier selection device and the horizontal position selection device into a gift outlet. The automatic gift selection device selects one of control devices for holding a gift guide device in a position to prevent the gift from slipping down and allowing the gift to slip down as necessary, thereby ejecting the necessary gift.

4 Claims, 5 Drawing Sheets

GAME MACHINE HAVING AUTOMATIC GIFT EJECTING FUNCTION

BACKGROUND OF THE INVENTION

1. Field of the Invention

The present invention relates to a game machine used in a penny arcade, an amusement park and so on, and more particularly, to a game machine having an automatic gift ejecting function which can automatically eject a gift selected by a game-like operation.

2. Description of the Related Art

Most of gifts used in game machines installed in a penny arcade or the like are various kinds of dolls and small articles, and the outward forms thereof are different in size and shape. On the other hand, a vending machine is widely used as a machine for automatically ejecting articles. However, the articles to be ejected take an extremely fixed form. Furthermore, though gift ejecting machines for children are also widely used, gifts are sealed in transparent cases or capsules of a fixed shape and the outward form thereof are fixed in most of such machines.

Still furthermore, such machines for offering gifts are generally installed separately from game machines.

It is desirable that users enjoy as many amusing atmospheres of games as possible in the penny arcade or the like. Since they come to enjoy games, it is preferable that they obtain gifts while playing games. However, no proper machine which can respond to such desire has been found up to now.

SUMMARY OF THE INVENTION

The present invention aims to solve the above problem, and therefore, it is an object of the present invention to provide a game machine having an automatic gift ejecting function by which users can sufficiently enjoy playing a game and obtaining a gift in a penny arcade or the like.

In order to achieve the above object, a game machine having an automatic gift ejecting function according to the present invention in which a gift is selected based on an operation of an operator is comprised of a gift display portion including a plurality of vertically arranged tiers, each having a plurality of gifts placed horizontally, a selection indicating means for indicating gift selection positions corresponding to the gifts, a tier selection means for selecting one of the plural tiers, a horizontal position selection means for selecting one of the horizontally arranged positions, an automatic gift ejecting means for automatically ejecting a gift selected by the tier selection means and the horizontal position selection means into a gift outlet, and a control portion for controlling the tier selection means, the horizontal position selection means, the selection indicating means and the automatic gift ejecting means based on the operation of the operator.

The gift display portion includes a plurality of vertically arranged tiers which are shifted one by one in the backward direction from the bottom and on each of which a plurality of gifts are placed horizontally.

The selection indicating means includes lamps located near the gift display positions in the gift display portion for indicating that a gift selection operation is being performed, and lights the lamps of the tiers to be selected during tier selection as well as the lamps for the horizontal positions during horizontal position selection.

The tier selection means selects one of the plural tiers in response to a stop operation of the cyclic lighting of the lamps performed by the selection indicating means.

The horizontal position selection means selects one of the horizontal positions in response to a stop operation of the cyclic lighting of the lamps related to the horizontal positions performed by the selection indicating means.

The automatic gift ejecting means houses gifts in a plurality of containers and ejects the gift in a designated one of containers. The automatic gift ejecting means is comprised of an eject guide means made of a container or a part of the container and mounted movably between a position to prevent a gift from slipping down and a position to allow the gift to slip down, a control means mounted corresponding to the eject guide means for first holding the eject guide means in the gift slip prevent position and allowing the gift to slip down as necessary, and a driving means for driving the control means.

DESCRIPTION OF THE PREFERRED EMBODIMENTS

The present invention will now be described in more detail with reference to the drawings.

Figure 1:
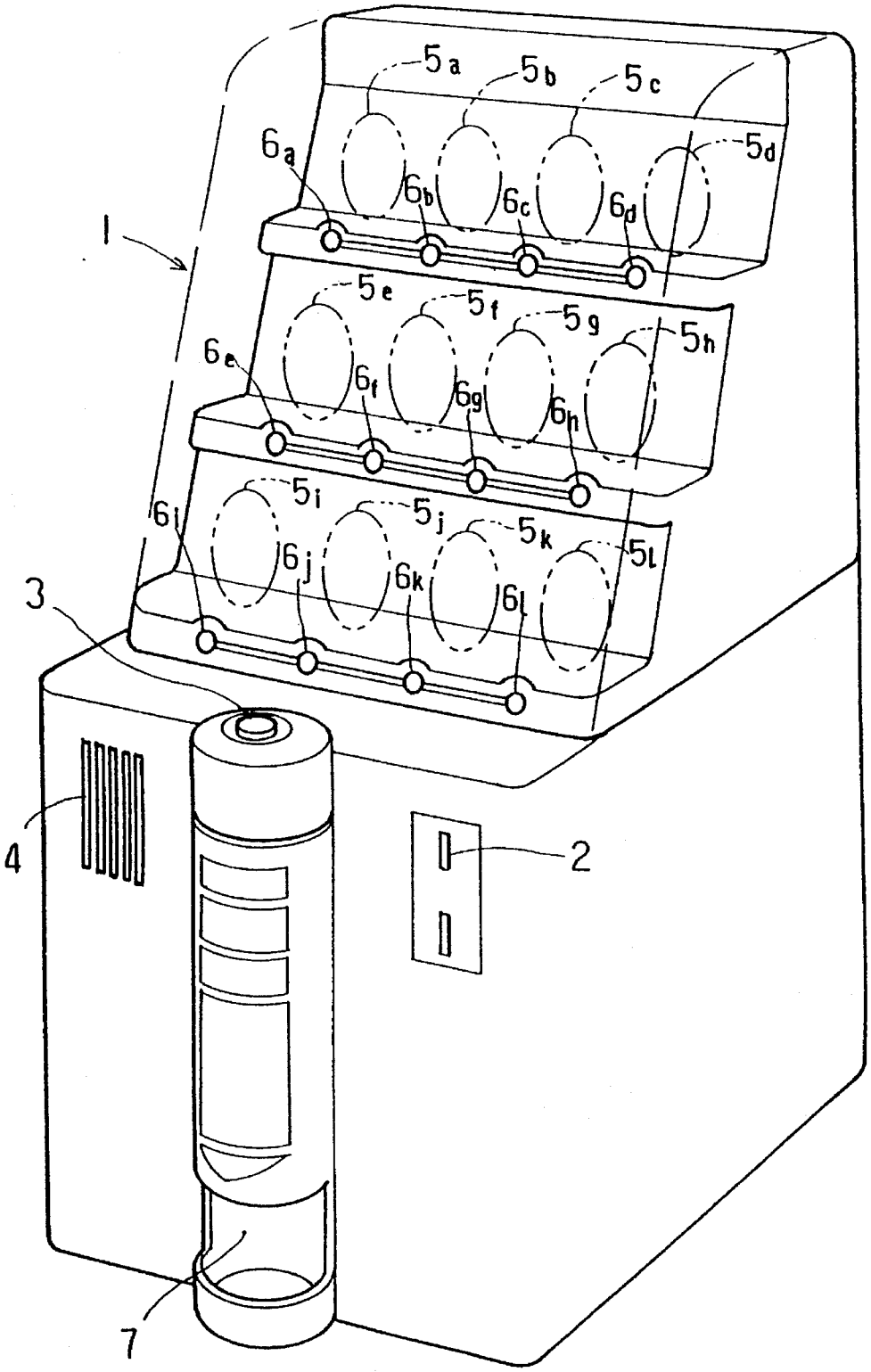
FIG. 1 is a perspective view showing the outward appearance of a game machine according to an embodiment of the present invention.

FIG. 1 is a perspective view showing the outward appearance of an embodiment of a game machine having an automatic gift ejecting function according to the present invention.

Referring to FIG. 1, the game machine is constituted by a gift display portion 1 including tiers shifted backward one by one from the bottom like a tiered stand for dolls or a stair case, a slot 2 for coins or tokens obtained from other games to be exchanged with gifts according to the number thereof, a push button 3 used in an operation of selecting a gift, a speaker 4 for guiding a user with voice, gift display positions *5a*, *5b* . . . *5l*, indicator lamps *6a*, *6b* . . . *6l* respectively corresponding to gifts for indicating which gift is being selected, and a gift outlet 7.

Figure 2:
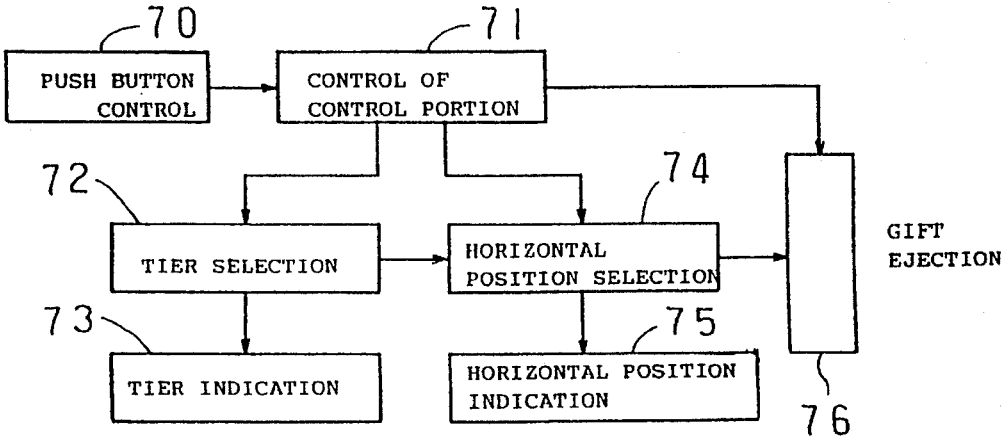
FIG. 2 is a functional system diagram showing moving operations of an electronic circuit built in the game machine of the embodiment shown in FIG. 1.

FIG. 2 is a functional system diagram showing moving functions of an electronic circuit built in the game machine of the embodiment shown in FIG. 1. The electronic circuit has the functions of controlling the push button 70, controlling a control portion 71, selecting a designated tier 72, indicating the designated tier 73, selecting a designated horizontal position 74, indicating the designated horizontal position 75, and ejecting a gift 76.

Figure 3:
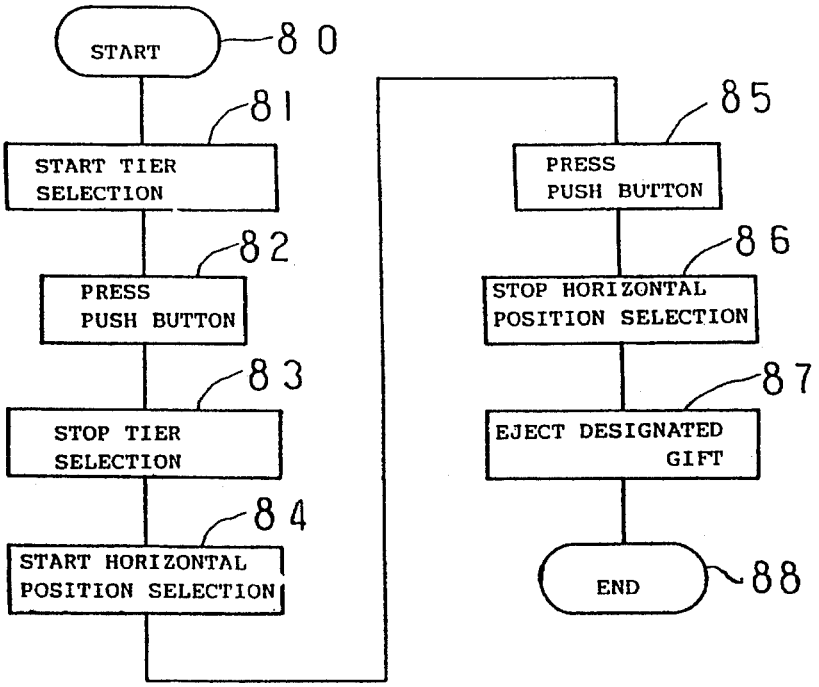
FIG. 3 is a flow chart showing a procedure of control operations of a control portion shown in FIG. 2.

FIG. 3 is a flow chart showing a procedure for controlling operations in the control portion control function 71 shown in FIG. 2. Numerals 80 to 88 denote steps in the procedure. Referring to FIG. 3, when the game machine shown in FIG. 1 starts its operation (Step S80), the selection of one of the upper, middle and lower tiers, on which a gift to be desired is placed, is started (Step S81). At this time, the lamps on the upper tier (the lamps 6*a*, 6*b*, 6*c* and 6*d* are lighted all together), the lamps on the middle tier (the lamps 6*e*, 6*f*, 6*g* and 6*h* are lighted all together) and the lamps on the lower tier (the lamps 6*i*, 6*j*, 6*k* and 6*l* are lighted all together) are sequentially lighted in cycles. While the lamps are being lighted in cycles, when the push button 3 is pressed (Step S82), the cyclic lighting is stopped at that moment (Step S83) and one of the tiers is selected.

Then, the selection of one of positions arranged in the horizontal direction on the selected tier is started (Step S84). If the middle tier shown in FIG. 1 is selected, the first, second, third and fourth lamps from the left (6*e*, 6*f*, 6*g* and 6*h*) are lighted sequentially in cycles.

While the lamps are being lighted in cycles, when the push button 3 is pressed (Step S85), the cyclic lighting is stopped at that moment (Step S86), and one horizontal position is selected. If the display position 5*f* is selected, the lighting is stopped at the lamp 6*f*, a gift in the position 5*f* corresponding to the lamp 6*f* is ejected into the gift outlet 7 (Step S87), and then, the lamp 6*f* is turned out (Step S88).

Figure 4:
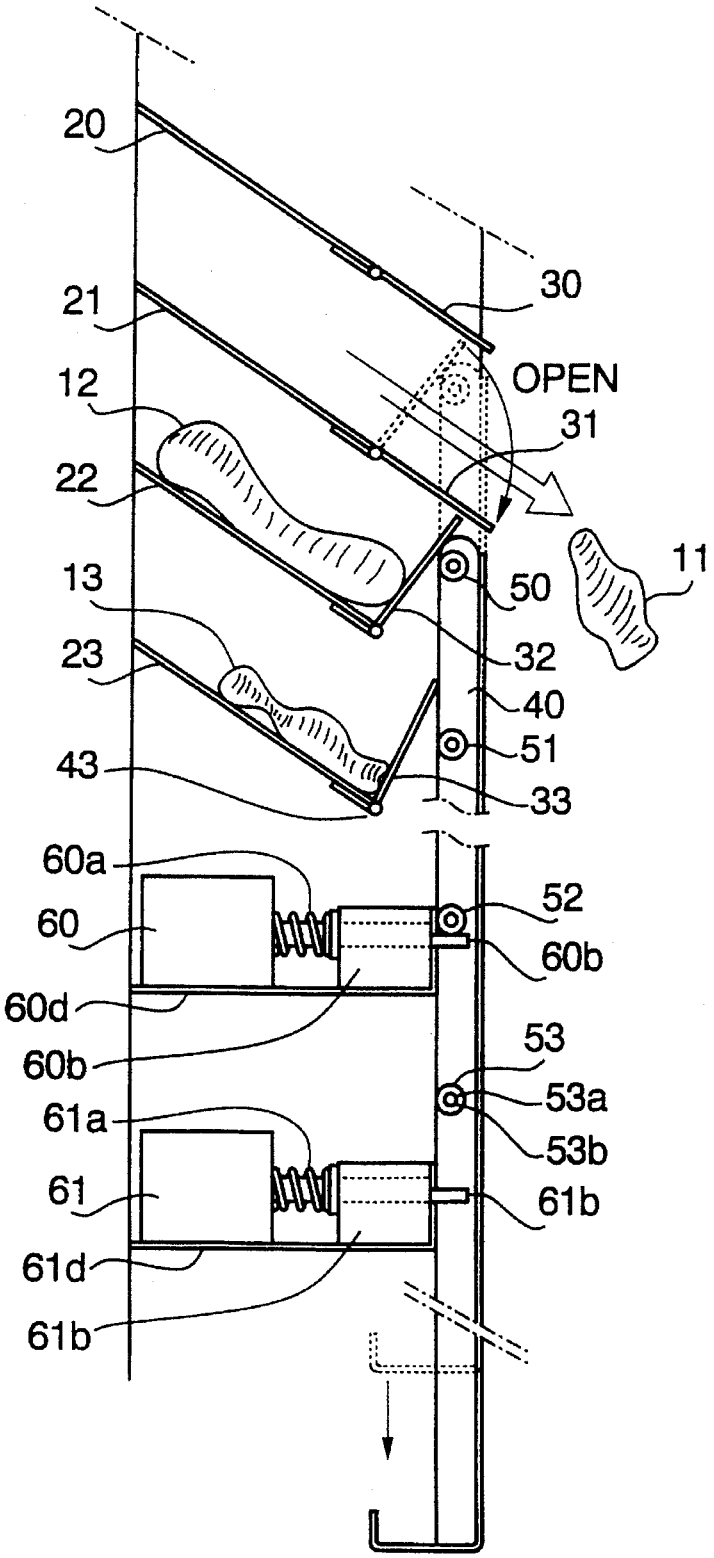
FIG. 4 is a sectional side view showing an embodiment of an automatic gift ejecting device incorporated in the embodiment shown in FIG. 1.
Figure 5:
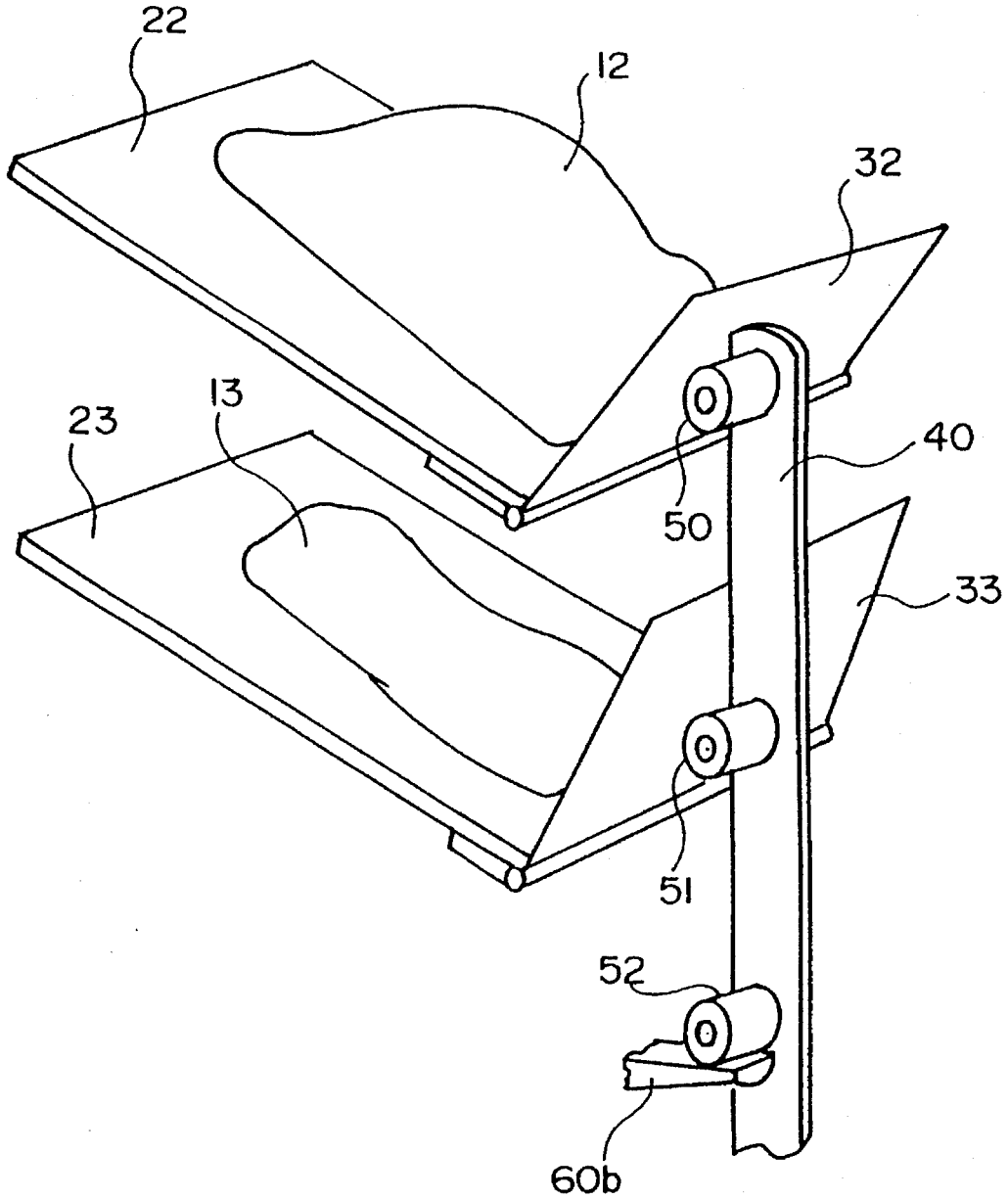
FIG. 5 is a perspective view showing a taken out part of an eject shelf in the device shown in FIG. 4.

FIG. 4 is a sectional side view showing an automatic gift ejecting device used in the game machine according to the embodiment of the present invention. FIG. 5 is a perspective view showing a partly taken out eject shelf in the device shown in FIG. 4. The automatic gift ejecting device is provided with inclined shelf boards 20 to 23, and movable covers 30 to 33 are pivotally mounted respectively at the bottom ends (the right ends in FIG. 4) of the shelf boards 20 to 23.

In front of (on the right side in FIG. 4) the movable covers 30 to 33, a control rod 40 is guided and supported movably in the upward and downward directions, and provided with pins 50 to 53 planted therein. The shape of the pin 53 among the pins 50 to 53 will be described as an example. A center shaft 53*a* of the pin 53 is fixed to the control rod 40, and a shock absorption tube 53*b* made of urethane resin is mounted therearound.

Below the ejection shelf, solenoids 60 and 61 are mounted to be linked with the pins 50 to 53. Since the solenoids 60 and 61 have almost the same structure, only the solenoid 60 will be described. The solenoid 60 is fixed to a solenoid table 60*d*, and a shaft thereof is retractably supported by a bearing, urged by a spring 60*a* in the projecting direction, and retracted against the urging force of the spring 60*a* when the solenoid 60 is supplied with electric power.

As shown in FIG. 5, when the control rod 40 takes the top position, the movable covers 30 to 33 are pushed up by the control rod 40 to face upward, thereby forming housing spaces (containers) for gifts 11, 12, 13 and so on in cooperation with the corresponding shelf boards. FIG. 4 shows a state in which the control rod 40 is lowered by two steps. A position shown by a broken line corresponds to a state in which the control rod 40 is lowered by one step and the movable cover 30 on the top shelf board is open. When the control rod 40 further descends by one step from this position, the movable cover 31 of the second shelf board is opened and the gift 11 in the second housing space is ejected by gravity. When the solenoid 60 is driven and a leading end 60*b* of the shaft thereof is retracted in this state, the retention of the pin 52 is released by the retraction of the leading end 60*b* and the control rod 40 descends. Then, the pin 53 is received by a leading end 61*b* of the solenoid 61, and the descent of the control rod 40 is obstructed. The movable covers 30 to 33 are opened one by one from the top by alternatively actuating the solenoids 60 and 61, and the gifts which are prevented from falling by the covers 30 to 33 are ejected one by one.

Gifts can be selectively ejected by preparing a plurality of automatic gift ejecting devices described above which house different kinds of gifts therein. For example, in the case of the embodiment shown in FIG. 1, a plurality of automatic gift ejecting devices house the same gifts as displayed gifts (in the positions 5*a* to 5*l*) and one of the automatic gift ejecting devices ejects a designated gift determined based on the selecting operation of the above-mentioned electronic circuit. A gift may be automatically ejected in correlation to another game machine according to the score thereof. If a housing body, inclined shelf boards and movable covers of the automatic gift ejecting device are made of transparent plates, the staff and players can see gifts and the moving states of the gifts from outside.

Figure 6:
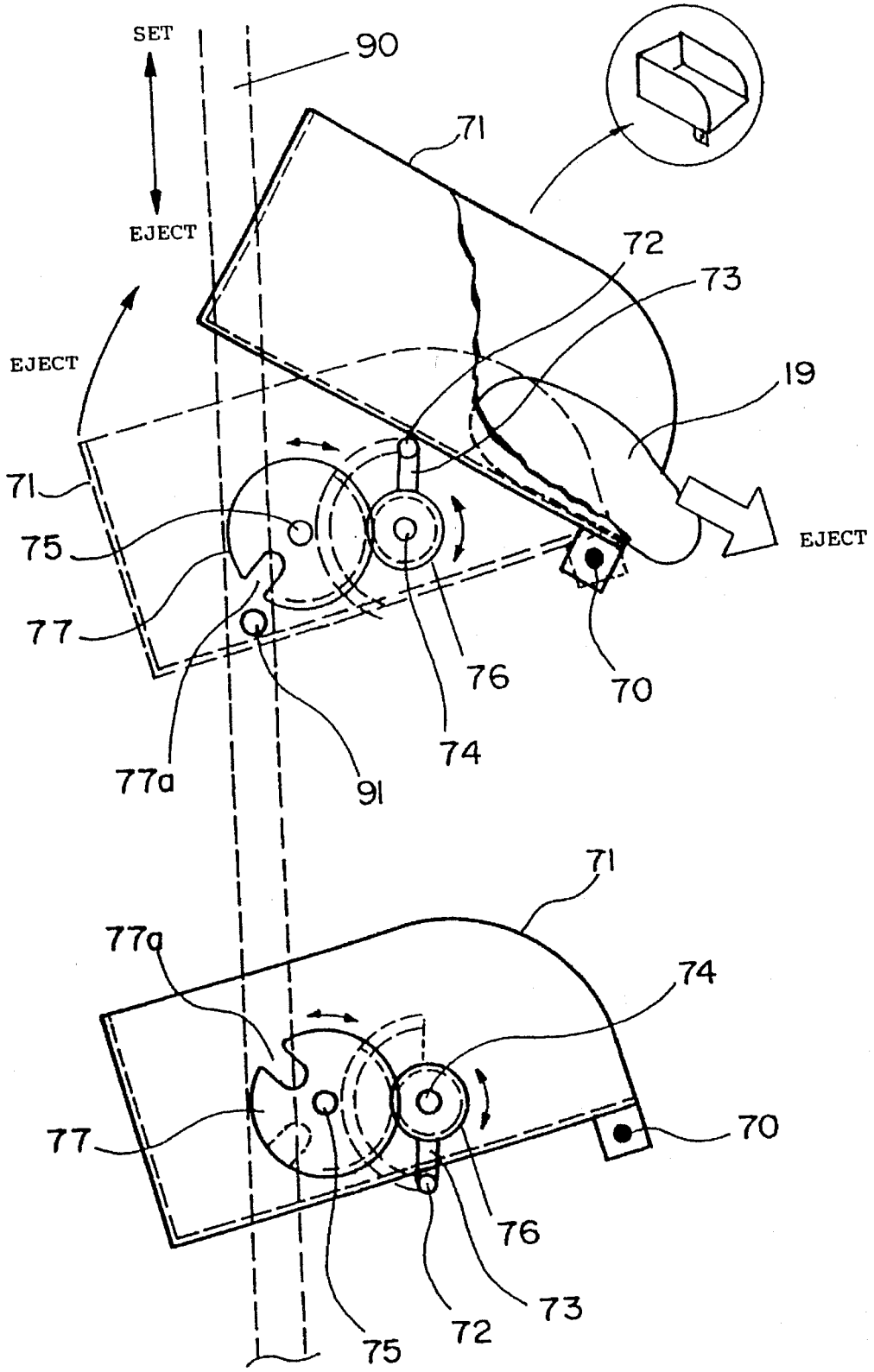
FIG. 6 is a sectional side view showing another form of an automatic gift ejecting device incorporated in the game machine of the embodiment shown in FIG. 1.

FIG. 6 is a sectional side view showing another form of the automatic gift ejecting device used in the embodiment of the present invention. This device is so designed as to eject a gift 19 by tilting a container itself for housing the gift 19.

Containers 71 and 71 are pivotally supported by right shafts 70 and 70. The upper container 71 is illustrated in a state in which a wall thereof is partly broken away in order to provide a clear understanding of an ejection state of the gift 19 housed therein.

In this form, a chain 90 and a pin 91 mounted thereto are used instead of the above-mentioned control rod 40 shown in FIG. 4. Since the chain 90 is positioned in front of the containers 71 in the figure, it is shown by a broken line. Gear shafts 74 and 75 are planted in an unillustrated wall, and respectively provided with gears 76 and 77 which are engaged with each other. Arms 73 are respectively fixed to the gears 76 and have lever pins 72 at the leading ends thereof. Each of the gears 77 has a notch 77*a*.

The lower container 71 shown by a solid line and the upper container 71 shown by a broken line are in the right downward tilting position to respectively receive the gifts 19 therein.

When the pin 91 of the chain 90 descends from above, engages with the notch 77*a* of the gear 77, further descends and turns the gear 77 counterclockwise, the gear 76 engaged with the gear 77 is turned clockwise. Then, the lever pin 72 at the leading end of the arm 73 which is integral with the gear 76 pushes up and lifts the upper container 71, which is turned or pivoted from the position shown by the broken line to the position shown by a solid line, thereby ejecting the gift 19 housed in the upper container 71 by causing the gift to slip downwardly and out of the container.

Furthermore, as the chain 90 descends, the pin 91 engages with the notch 77*a* of the gear 77 related to the lower container 71 and turns the gear 77 counterclockwise. The gear 74 engaged with the gear 77 is turned clockwise thereby, and the lever pin 72 of the lever 73 integral with the gear 74 pushes up the bottom of the container 71. The container 71 is pivoted about the shaft 70 clockwise and ejects a gift housed therein.

As described above, gifts can be sequentially ejected by making the pin 91 descend in correlation to the movement of the chain 90 and driving the gears related to the containers.

A plurality of automatic gift ejecting devices having the structure shown in FIG. 6 may be prepared in the same manner as in the automatic gift ejecting devices shown in FIG. 4 in order to supply a plurality of kinds of gifts.

As described in detail above, a game machine having an automatic gift ejecting function according to the present invention is comprised of a gift display portion including a plurality of vertically arranged tiers each having a plurality of gifts placed horizontally, a selection indicating means for indicating gift selection positions corresponding to gift display positions of the gifts, a tier selection means for selecting one of the plural tiers, a horizontal position selection means for selecting one of the horizontally arranged positions, an automatic gift ejecting means for automatically ejecting a gift selected by the tier selection means and horizontal position selection means into a gift outlet, and a control portion for controlling the tier selection means, the horizontal position selection means, the selection indicating means and the automatic gift ejecting means. Therefore, the player can obtain the same gift as a displayed gift by selecting a tier and a horizontal position of the gift while enjoying a game.

The gifts are displayed on the tiers which are shifted one by one in the backward direction from the bottom, and lamps for indicating the gifts being selected are mounted near the gift display positions. The lamps for indicating the tiers are lighted in cycles while one of the tiers is being selected, and the lamps for indicating the horizontal positions on the selected tier are lighted in a cycle while one of the horizontal positions on the selected tier is being selected. The selection of the tier and the horizontal position is determined by performing an operation to stop the cyclic lighting of the lamps. These points further enhance the amusing atmosphere.

Still furthermore, an automatic gift ejecting device houses gifts in a plurality of containers and ejects the gift in a designated one of the containers. The automatic gift ejecting device is comprised of an eject guide means made of a container or a part of a container and mounted movably between a position to prevent the gift from slipping down and a position to allow the gift to slip down, a control means mounted corresponding to the eject guide means for first holding the eject guide means in the gift slip prevent position and allowing the gift to slip down as necessary, and a driving means for driving the control means.

Therefore, it is unnecessary to fix the form of gifts, and the gifts may be housed in the containers in an unwrapped state or in cheap bags made of, for example, vinyl. Since expensive transparent cases are not needed to house the gifts, the cost of the gifts can be reduced considerably.

What is claimed is:

1. A game machine having an automatic gift ejecting function for selecting a gift based on an operation of an operator, comprising:

a housing having a gift display portion and a gift outlet, with said gift display portion including a plurality of vertically arranged tiers each having a plurality of horizontally arranged gift display portions;

selection indicating means for indicating the respective gift display positions for the gifts;

tier selection means for selecting one of said plurality of tiers;

horizontal position selection means for selecting one of said plurality of gift display positions of a selected tier;

automatic gift ejecting means for automatically ejecting a gift from the one of said gift display positions selected by said tier selection means and said horizontal position selection means into said gift outlet; and a control portion for controlling said tier selection means, said horizontal position selection means, said selection indicating means and said automatic gift ejecting means based on said operation; and with said selection indicating means including respective lamps located near each of said gift display positions in said gift display portion for indicating which gift display position is being selected and cyclically lighting said lamps of the respective said tiers to be selected during tier selection as well as cyclically lighting at least said lamps of said horizontal positions of a selected tier during horizontal position selection, said tier selection means selecting one of said plurality of tiers in response to a stop operation for the cyclic lighting of said lamps performed by said selection indicating means during tier selection, and said horizontal position selection means selecting one of said horizontal positions in response to a stop operation for the cyclic lighting of said lamps related to said horizontal positions performed by said selection indicating means.

2. A game machine having an automatic gift ejecting function according to claim 1, wherein said plurality of tiers are shifted backward one by one from the bottom like the steps of a stair case to form a stair step stand.

3. A game machine having an automatic gift ejecting function according to claim 1, wherein said automatic gift ejecting means includes a plurality of containers, each for housing a respective gift and each disposed at a respective one of said display positions, and means for ejecting a respective gift in a designated one of said containers comprised of eject guide means formed of respective ones of said containers or a part of said containers which are pivotably mounted in said housing for movement between a first position to prevent a gift from slipping down and out of a container and a second position to allow a gift to slip down and out of a container, and control means mounted to cooperate with said eject guide means for first holding said eject guide means in the first gift slip prevent position and for causing said eject guide means to move to said second position and a gift to slip down when a respective container is selected, and driving means for driving said control means.

4. A game machine having an automatic gift ejecting function according to claim 3, wherein said plurality of tiers are shifted backward one by one from the bottom like the steps of a stair case to form a stair step stand.

* * * * *